United States Patent [19]

Williams

[11] 4,381,087

[45] Apr. 26, 1983

[54] ADJUSTABLE WIRE REEL

[76] Inventor: Loren J. Williams, 1951 Hurst Ave., San Jose, Calif. 95125

[21] Appl. No.: 244,607

[22] Filed: Mar. 17, 1981

[51] Int. Cl.[3] ..... B65H 75/24

[52] U.S. Cl. ..... 242/110; 242/110.3

[58] Field of Search ..... 242/110-110.3, 242/115, 86, 86.1, 86.5 R, 86.5 A, 100, 104, 105; 225/46, 47

[56] References Cited

U.S. PATENT DOCUMENTS

| | | | |
|---|---|---|---|
| 732,835 | 7/1903 | Delphey | 242/110.3 |
| 742,296 | 10/1903 | Delphey | 242/110.3 |
| 1,056,410 | 3/1913 | Gochik | 242/110 |
| 1,352,458 | 9/1920 | Keyworth | 242/110.3 |
| 2,797,880 | 7/1957 | Miller et al. | 242/110 |

*Primary Examiner*—Leonard D. Christian

*Attorney, Agent, or Firm*—Paul L. Hickman

[57] ABSTRACT

An adjustable wire reel including a tubular hub and three arm assemblies extending radially outwardly from the hub. The length of the arm assemblies are quickly adjusted to fit standard wire coil sizes, and the flanged members at the end of the arm assemblies are rotatable between a substantially radial position and a substantially tangential position. A spring locks the flanged members in the radial position.

9 Claims, 5 Drawing Figures

ADJUSTABLE WIRE REEL

BACKGROUND OF THE INVENTION

1. Field of the Invention

This invention relates generally to spool, bobbins, reels and similar structures, and more particularly to industrial purpose reels that can hold large coils of wire.

2. Description of the Prior Art

Wire purchased in industrial quantities are commonly wound into large, unbound coils having internal diameters ranging from 6½ to 8½ inches. These coils are packed in boxes to protect the wire and to prevent their unravelling.

The wire can be unwound from the coil either from its interior end where the coil windings were started, or from its exterior end where the coil windings were finished. The best way to unwind the wire is to remove it from its exterior end by rotating the entire coil. If the wire is removed by pulling an end of the wire from the top or the bottom of the coil, the wire will kink, bind and bend due to a helical twisting of the wire.

To facilitate the proper way of unwinding large coils of wire several inventors have devised wire pay-out reels. For example, in U.S. Pat. No. 718,194 of J. Delphey a wire pay-out reel is described including a stand, a hub rotatably mounted on the stand, and four arm members extending from the hub were each arm member is provided with an adjustable, wire retaining upright. A coil of wire is dropped or wound around the uprights and wire is removed by pulling the exterior end of the wire and allowing the coil to rotate with the device.

In U.S. Pat. No. 1,783,692 H. Bensema discloses a reel featuring arms of adjustable length. Similar devices are also described in U.S. Pat. Nos. 1,252,483; 1,943,512; 1,408,743; and 1,352,458.

A problem that the prior art does not address is how to produce wire reels that can stand up to the rigors of industrial usage. For example, the set screws for the arm adjustments on most prior art wire reels are of the ineffectural thumbscrew tye. Furthermore, the wire retaining members are often weak in construction and probably unable to withstand the strong lateral and radially normal forces exerted on a wire retaining reel.

Another problem that the prior art does not address is how to make a heavy duty wire reel that is quickly adustable to accept standard wire coil sizes. Most wire packaged for industrial use is provided in coil form with 6½, 7, 7½, 8, 8½, or 9 inch internal diameters.

SUMMARY OF THE INVENTION

It is an object of this invention to provide a heavy duty wire reel that can withstand misuse and the heavy normal usage of industrial applications.

It is a further object of this invention to provide a wire reel that is quickly adjustable to accept standard size coils of wire.

Briefly, the invention includes a tubular hub and three radial arm assemblies extending from the hub, where each arm assembly includes a first arm member attached to the hub, a second arm member in telescopic engagement with the first arm member, a rim piece attached to the second arm member, and a pair of flange members resiliently coupled to the top and the bottom of the rim piece.

In use, the top flange members are raised, rotated, and relowered so as to be substantially tangential to the rim pieces, and a coil of wire is dropped over the rim pieces. After the top flange members are raised, rotated and relowered to their original radial positions the tubular hub is engaged with a shaft of a wire rack. The coil is unwound by pulling on the exterior end of the wire and allowing the reel and coil to rotate around the shaft.

The flange members include a tab section which slidingly engage a portion of the rim piece to prevent rotation of the flange members and generally to lock them in position. The two arm members are strongly held together by a set pin that extends through bores provided at precise intervals along the length of the arm members.

An advantage of this invention is its structural strength which allows it to be used and abused without mechanical failure. For example, the set pin arrangement for holding together the arm members is far stronger than a set screw arrangement. Moreover, the unique attachment between the rim piece and the flange members provides great strength yet allows for the quick insertion or removal of wire coils.

Another advantage of this invention is that it is quickly adjustable to fit standard sized wire coils. By calibrating the bores in the two arm members the device can be adapted to fit 6½ to 9 inch internal diameter coils by simply removing the set pins, sliding the arm members into position, and reinserting the set pins. Of course, by varying the length of the two arm members and by changing the distance between the set pin bores any sized wire coil could be used with this invention.

These and other objects and advantages of the present invention will no doubt become apparent upon a reading of the following descriptions and a study of the several figures of the drawing.

DETAILED DESCRIPTION OF THE PREFERRED EMBODIMENT(S)

Figure 1:
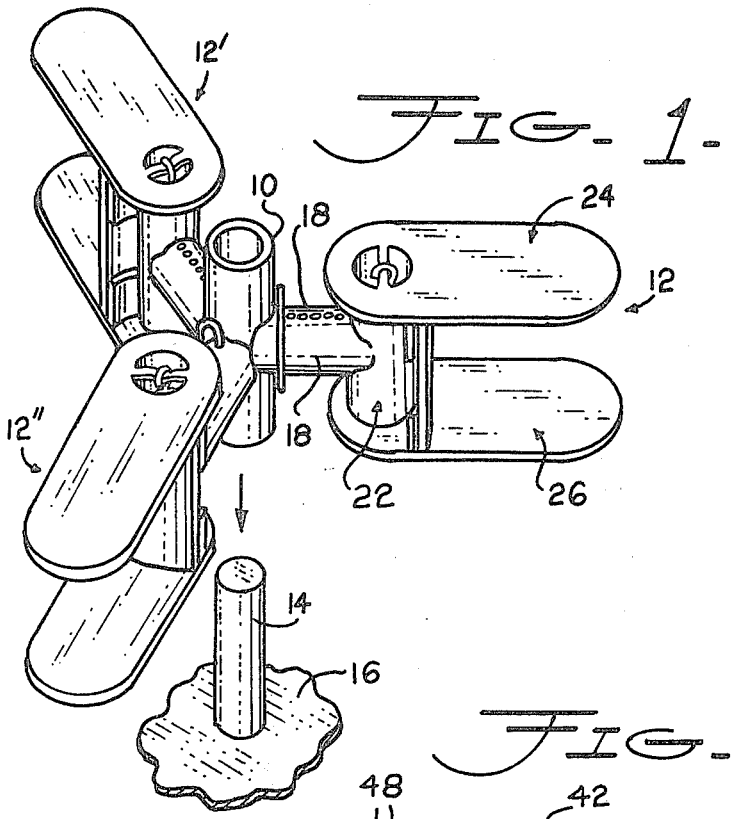
FIG. 1 is a perspective view of AN ADJUSTABLE WIRE REEL in accordance with the present invention.

Referring to the perspective view of FIG. 1, a wire reel in accordance with the present invention includes a tubular hub 10 and three arms assemblies 12, 12' and 12''. Since the arm assemblies are identical reference numerals will only be associated with arm assembly 12.

Hub 10 is a short length of pipe preferably formed, as it the rest of this device, from a durable metal alloy. The tubular hub is receptive to a post or shaft 14 attached to a wire rack 16. The hub is free to rotate around the shaft.

Figure 2:
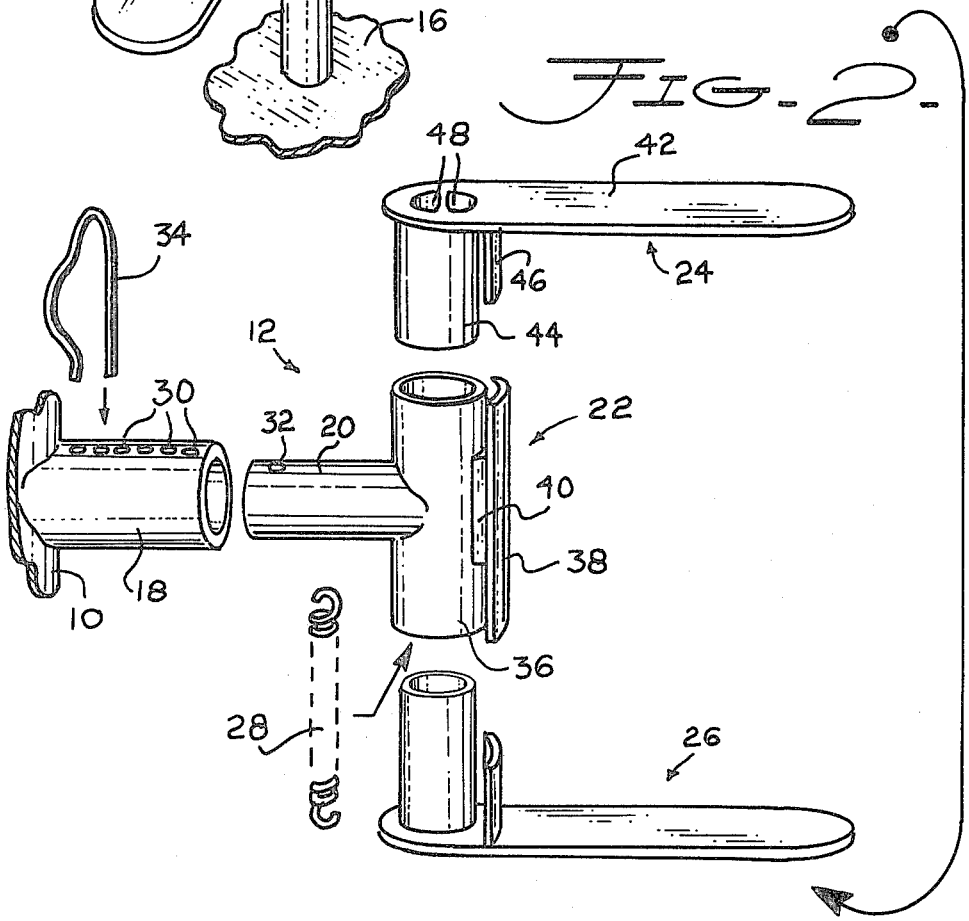
FIG. 2 is a perspective view, partially exploded, of one of the arm assemblies shown in FIG. 1.

With additional reference to the exploded view of FIG. 2, arm assembly 12 includes a first arm member 18 attached to the hub, a second arm member 20 telescopically engaged with arm member 18, a rim piece 22 attached to arm member 20, a pair of flange members 24 and 26, and a spring 28 disposed within rim piece 22 and resiliently coupling the flange members together.

The arm members are preferably formed from short lengths of pipe where the internal diameter of arm member 18 is only slightly larger than the external diameter of arm member 20. Of course, the sizes of the tubular arm members could be interchanged so that arm member 18 could telescope within arm member 20 instead of the other way around.

Arm member 18 is provided with a number of holes 30 evenly spaced along its upper surface. Arm member 20 is provided with a single hole 32 in its upper surface. A set pin 34 is inserted through holes 30 and 32 to affix the two arm members together.

The holes 30 are preferably spaced ¼ of an inch apart center-to-center so that the diameter of the reel can be adjusted in ½ inch increments. Preferably, the first hole 30 is positioned so that, in its first position, the reel can accept a coil of wire with a 6½ inch internal diameter. By having six holes 30 spaced ¼ of an inch apart standard wire coils of up to 9 inches internal diameter can be held by this device.

The rim piece includes a tubular section 36 attached substantially normally to arm member 20, and a rim section 38 attached to the outermost part of the tubular section. The rim section is spaced from the tubular section by a spacer 40 for reasons to be discussed subsequently.

In this embodiment the flange members are identical and so only flange member 24 will be referenced. Member 24 includes and elongaged plate section 42, a tubular section 44 extending substantially normally from an end of the plate section, and a tab section 46 attached to the plate section and spaced from the tubular section 44 by a little more than the wall thickness of tubular section 36.

Spring 28 is disposed within section 36 and resiliently couples the flange members together. To facilitate the attachment of the spring to the flange members, a pair of slots 48 are provided in plate sections 42. The spring is preferably a helically wound extension type.

Figure 4:
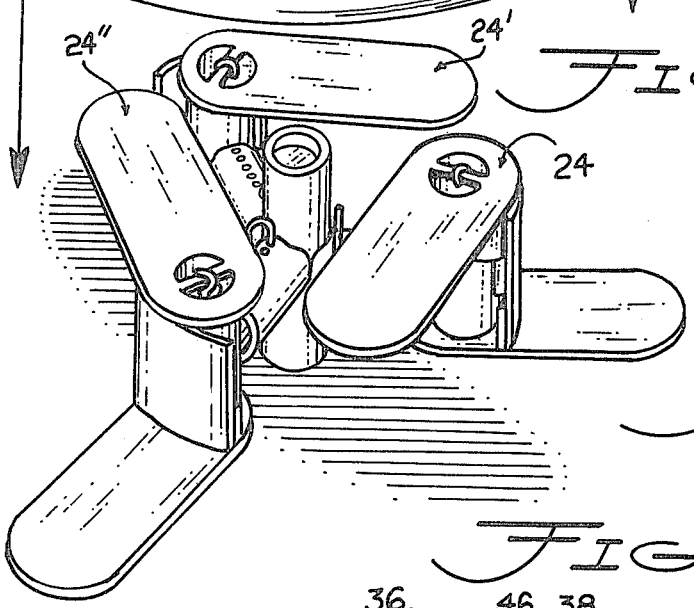
FIG. 4 is a top plan view of one of the arm assemblies shown in FIG. 1.
Figure 5:
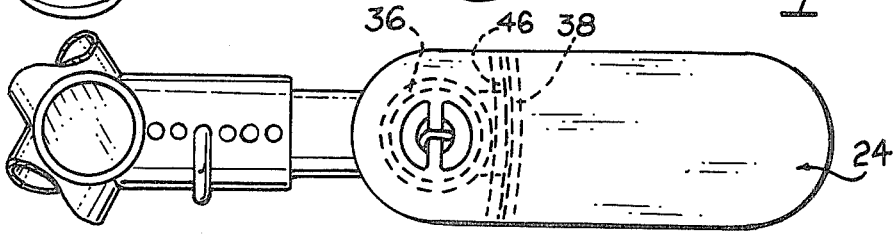
FIG. 5 is a partial top plan view of one of the arm assemblies shown in FIG. 1 with the top flange member tangentially rotated.
Figure 5:
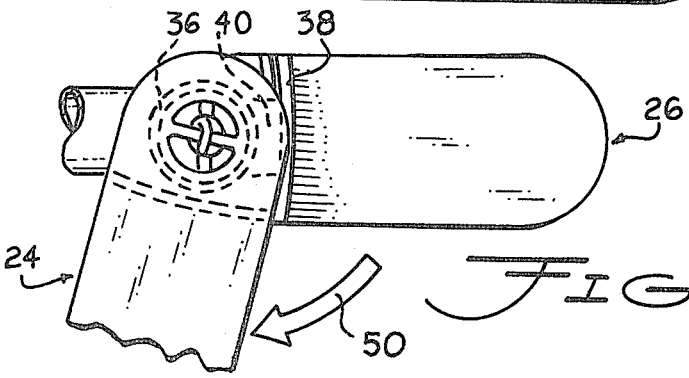

In FIG. 4 the flange member 24 is shown to be extending substantially radially, and in FIG. 5 the flange member 24 is shown to be positioned substantially tangentially to the rim piece. When in the position shown at FIG. 4 the tab section 46 engages the space between the rim section 38 and the tubular section 36 to firmly lock the flange member in its extended position. When in this position a coil of wire is securely held on the reel.

To rotate the flange member to the position shown in FIG. 5 it is first lifted against spring pressure to clear the tab section from the space between the tubular section 36 and rim section 38. The flange member is then rotated as shown at 50 until it is substantially tangential to the rim piece, and then it is lowered down on top of section 36. Spring pressure holds the flange member in this position.

Figure 3:
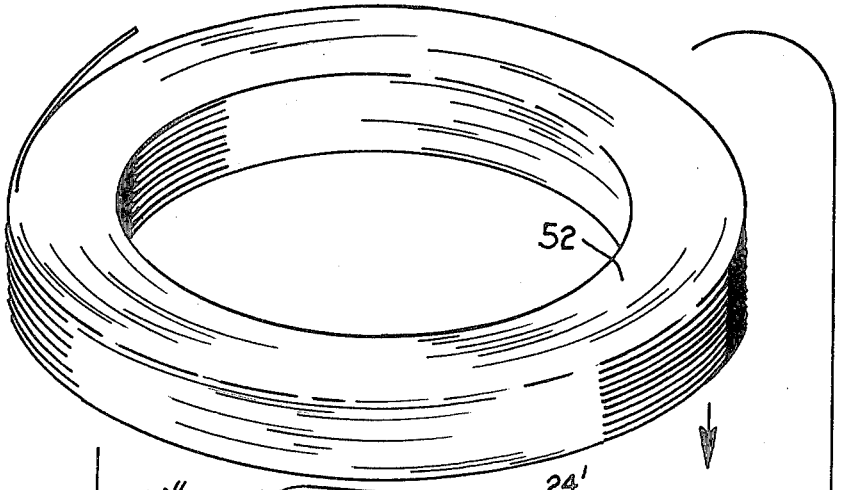
FIG. 3 is a perspective view of the reel shown in FIG. 1 with the upper flange members of the arm assemblies rotated to a substantially tangential position relative the rim pieces of the device. A coil of wire is shown about to be inserted onto the reel.

Referring to FIG. 3, when the flange members 24, 24', and 24'' are all in their tangential position a coil of wire 32 is dropped down ever the rim pieces. The flange members are then extended to their radial positions to securely hold the coil on the reel.

In the illustrated embodiment the flange members 24 and the flange members 26 are all identical in construction. In an alternative embodiment of the present invention the flange members 26 can be permanently attached to the end of section 36.

While this invention has been described in terms of a few preferred embodiments, it is contemplated that persons reading the preceding descriptions and studying the drawing will realize various alterations, permutations and modifications thereof. For example, it should be apparent that this invention can be constructed for any size coil of wire by changing the lengths of the arm members. Furthermore, although ½ inch increments in wire coil diameter is standard in the United States, other increments could be handled by varying the distance between holes 30.

It is therefore intended that the following appended claims be interpreted as including all such alterations, permutations and modifications as fall within the true spirit and scope of the present invention.

What is claimed is:

1. An adjustable wire reel comprising:

a tubular hub; and a plurality of arm assemblies evenly spaced around said hub and radially extending therefrom, each arm assembly including a first arm member attached to said hub, a second arm member telescopically engaged with said first arm member, an elongated rim means attached to said second member, a first flange member engaged with a first end of said rim means, a second flange member engaged with a second end of said rim means, and spring means for biasing said second flange member towards said second end of said rim means.

2. An adjustable wire reel as recited in claim 1 wherein said spring means biases said first flange member towards said first end of said rim means.

3. An adjustable wire reel as recited in claim 1 further comprising set means for affixing said first arm member to said second arm member.

4. An adjustable wire reel as recited in claim 3 wherein said first arm member is tubular and said second arm member slides telescopically within said first arm member, and wherein said set means includes a set pin extending through one of a plurality of bores provided in said first arm member and a bore provided in said second arm member.

5. An adjustable wire reel as recited in claim 4 wherein said plurality of bores are spaced ¼ of an inch apart, center to center.

6. An adjustable wire reel as recited in claim 1 wherein said rim means includes a tubular section attached at substantially right angles to said second arm member, and a rim section attached to and spaced from said tubular section.

7. An adjustable wire reel as recited in claim 6 wherein said first flange member and said second flange member each include an elongated plate section and a tubular section extending from an end of said plate section substantially normally thereto, whereby said tubular sections of said flange members telescopically engage said tubular section of said rim means.

8. An adjustable wire reel as recited in claim 7 wherein said spring means includes a spring disposed within said tubular section of said rim means and coupling said first flange member and said second flange member together.

9. An adjustable wire reel as recited in claim 8 wherein said first flange member and said second flange member each further include a tab section extending from said plate section for engaging said rim means between said tubular section and said rim section.

* * * * *